US007845383B2

(12) United States Patent
Bowman

(10) Patent No.: US 7,845,383 B2
(45) Date of Patent: Dec. 7, 2010

(54) ROMAN SHADE WITH INVERTED FAN SHAPE AT ITS BOTTOM

(76) Inventor: Suzette Bowman, 15413 Duckling Pl., Woodbridge, VA (US) 22191

( * ) Notice: Subject to any disclaimer, the term of this patent is extended or adjusted under 35 U.S.C. 154(b) by 245 days.

(21) Appl. No.: 11/888,357

(22) Filed: Aug. 1, 2007

(65) Prior Publication Data

US 2009/0032201 A1 Feb. 5, 2009

(51) Int. Cl.
*E06B 3/48* (2006.01)

(52) U.S. Cl. ..... 160/84.01; 160/84.07; 160/84.03

(58) Field of Classification Search ..... 160/84.04, 160/84.01, 84.07, 134
See application file for complete search history.

(56) References Cited

U.S. PATENT DOCUMENTS 5,097,885 A * 3/1992 Kitagawa ..... 160/84.01
5,197,526 A 3/1993 Schon
5,207,257 A 5/1993 Rupel
5,341,864 A 8/1994 Rupel
5,741,582 A * 4/1998 Leaderman et al. ..... 428/317.5
5,787,951 A 8/1998 Tonomura
5,894,876 A * 4/1999 O'Brien ..... 160/84.01
6,202,732 B1 * 3/2001 Chen ..... 160/370.23
6,431,245 B1 8/2002 Shen
6,591,887 B1 7/2003 Hsu
6,679,309 B2 1/2004 Hsu
6,923,236 B2 8/2005 Lin
6,959,749 B2 11/2005 Hsu
2005/0039862 A1 * 2/2005 Lin ..... 160/84.01
2006/0151127 A1 * 7/2006 Siegel ..... 160/84.04

* cited by examiner

*Primary Examiner*—Blair M. Johnson

(57) ABSTRACT

A window covering in the style of a Roman shade has a straight bottom edge when the shade is lowered and that forms into an inverted fan shape when the shade is raised. Spaced parallel creases in the shade simulate pleats when the shade is in a lowered position and promote accordion-folded pleats when the shade is raised. A pull cord behind the shade lifts the shade from its bottom edge and along its vertical centerline. A two-part bottom rail is secured in the bottom edge of the shade, and each part extends from an outer side edge of the shade to the midportion of the bottom edge, so that when the cord is pulled to raise the shade, the two parts pivot downwardly about the midportion, imparting an inverted fan shape to the bottom edge.

9 Claims, 3 Drawing Sheets

ROMAN SHADE WITH INVERTED FAN SHAPE AT ITS BOTTOM

FIELD OF THE INVENTION

This invention relates generally to window coverings, and more particularly to a window covering in the style of a Roman shade, with an inverted fan shape at its bottom.

BACKGROUND ART

Window coverings are provided in a variety of styles and materials, including: blinds that comprise individual horizontal or vertical slats of wood, plastic or metal; and curtains, drapes and shades of fabric or other material.

Blinds can be raised and lowered to selectively cover or uncover a window opening, and the individual slats can be pivoted between spaced, parallel, open positions and overlapping closed positions, but other than these adjustments the initial configuration or shape of the blinds remains fixed.

Curtains and drapes typically hang vertically at opposite sides of a window opening and generally remain fixed in their initial shape and position at the sides of the opening, although they usually can be moved inwardly across the window opening to cover it. However, other than being movable between open and closed positions they retain their initial shape or design.

Shades typically hang from the top of a window opening and can be moved between a lowered position covering the opening and a raised position exposing some or all of the opening. Shades come in a variety of styles and shapes, and generally have a straight horizontal bottom that remains straight and horizontal during use. A popular style of shade, referred to in the art as a Roman shade, is horizontally pleated. The pleats typically are formed by gathering and folding vertically spaced sections of the material and stitching it together. Most conventional Roman shades have a straight, horizontal bottom, but shades are known that have a bottom that can assume different shapes by pulling a selected pull cord or pull cords to unevenly raise different portions of the bottom of the shade. One of these latter designs has a sectional bottom rail that is hinged or interrupted at its midportion and a pull cord is connected to the middle of the bottom of the shade so that when the cord is pulled the middle of the shade bottom is raised, causing the pleated shade to assume an inverted fan shape at the bottom. The shades described in U.S. Pat. Nos. 5,207,257, 6,431,245 and 6,959,749 are exemplary of the latter type of shades.

Conventional pleated Roman shades are of relatively complex design, in which the material of the shade is gathered and stitched together to form the pleats, producing a relatively heavy and bulky appearance. Further, and at least in those shades described in the patents noted above, there are multiple pull cords that operate to raise and lower the shade in different configurations. Moreover, in those shades known to applicant the pull cords are located at the front of the shade.

Accordingly, it would be desirable to have a shade in the style of a pleated Roman shade, with an inverted fan shape at its bottom edge, but wherein the pleats are formed without gathering and stitching the material, whereby the shade has a lighter and crisper appearance, and wherein only a single pull cord is used to operate the shade, with the pull cord located behind the shade.

DISCLOSURE OF THE INVENTION

The present invention comprises a window covering in the style of a pleated Roman shade whose bottom edge forms into an inverted fan shape when the shade is raised, wherein the shade is made of a material that is creased to simulate and form pleats without the need for gathering and stitching the material, whereby the shade has a lighter and crisper appearance than a conventional Roman shade, and wherein only a single pull cord is located behind the shade to operate the shade.

More particularly, the shade of the invention is made of a multi-layered composite material, comprising a front layer selected from a desired fabric, an intermediate layer of a fusible interfacing, and a back layer selected from a desired lining material. The fusible interfacing is fused to the lining, and the three layers are folded and stitched together at opposite side edges of the shade, with the seam on the back of the shade so that the front is uniform and free of seams. When the composite material of the shade is folded to form pleats and then subjected to heat and pressure, i.e., ironed, the fusible interfacing is permanently creased, so that when a shade made with the material is in a lowered position, i.e., unfolded, the creases define parallel horizontal areas that simulate pleats. The creases initiate or induce folding of the material into an accordion-folded pleated pattern when the shade is raised. The interfacing also imparts stiffness to the shade to maintain its shape. In a preferred embodiment the interfacing is a fusible non-woven interfacing comprising 75% polyester and 25% rayon, available from Jo-Ann Stores, Inc., but it should be understood that different interfacings could be obtained from other sources.

A single pull cord extends behind the shade and is connected at its distal end to the middle of the bottom edge of the shade. Thus, when the pull cord is operated it pulls the shade up from the middle of its bottom edge. The cord extends through a conventional commercially available cord latch and release mechanism mounted near one end of a head rail at the top edge of the shade, and through at least one pulley mounted to the head rail intermediate its ends. Guide rings are attached to the back of the shade along its vertical centerline, and the cord also extends through the guide rings, which are attached only to alternate pleat creases so that the shade can fold into its pleated design when it is raised. The guide rings may be pre-attached to a narrow strip of material, referred to as "ring tape", and the strip of material, with rings attached, then affixed to the back of the shade, i.e., to the lining, along its vertical centerline. Alternatively, the rings could be individually attached to the lining rather than being pre-attached to a strip of material that is, in turn, affixed to the lining. In a preferred embodiment the tape is adhesively attached to the lining rather than being stitched to it, thereby avoiding stitching together of the facing, lining and fusible interfacing.

A bottom rail is held within a pocket sewn into the bottom edge of the shade of the invention to weight the bottom of the shade and to maintain the shape of the bottom edge. The rail comprises two parts, each extending from a first end at an outer side edge of the bottom of the shade to a second end at the midportion of the bottom edge, whereby when the pull cord is operated to pull up the shade, the two parts of the bottom rail pivot downwardly about the midpoint of the bottom edge of the shade, imparting an inverted fan shape to the bottom edge. In a preferred embodiment the two-part bottom rail is made of wood and the outer ends are weighted to facilitate forming of the inverted fan shape when the center of the shade is pulled up by the pull cord.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE PREFERRED EMBODIMENTS

Figure 3:
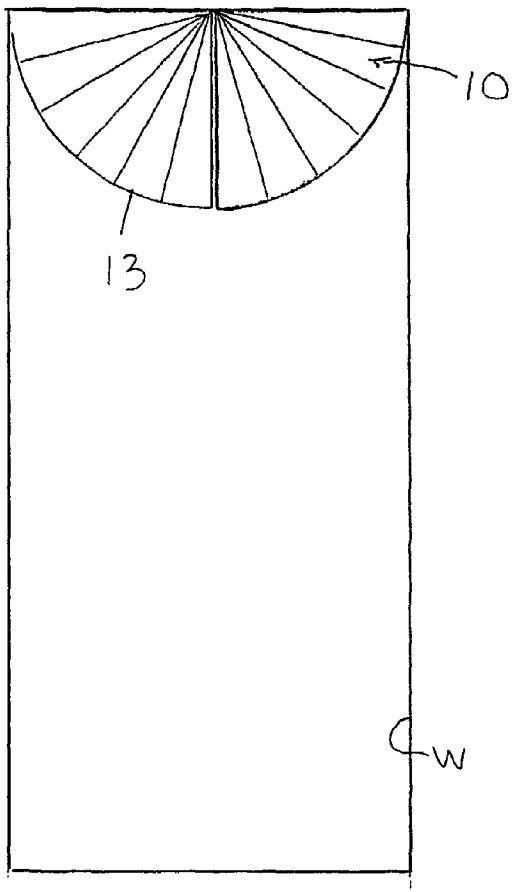
FIG. 3 is a front view in elevation of the shade of the invention, shown in a fully raised position, with the inverted fan shape formed at its bottom edge.
Figure 2:
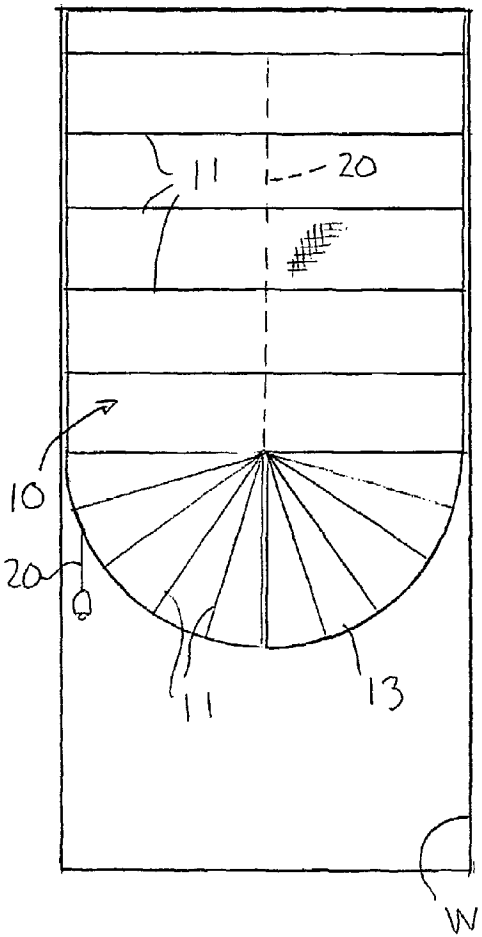
FIG. 2 is a front view in elevation of the shade of the invention, shown in a partially raised position, with an inverted fan shape formed at its bottom edge.
Figure 1:
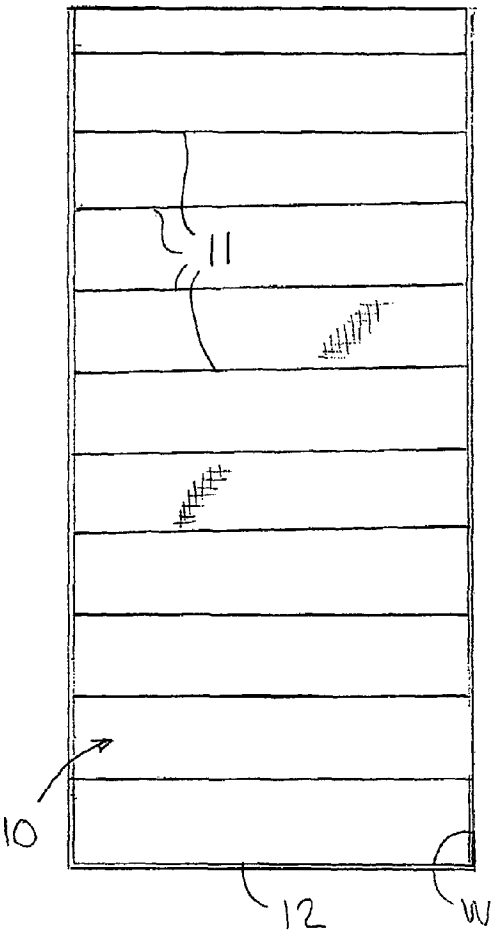
FIG. 1 is a front view in elevation of the shade of the invention, shown in its fully lowered position.

A window covering in accordance with the invention is indicated generally at 10 in FIGS. 1-5. The covering is in the style of a Roman shade, and has a plurality of evenly spaced horizontal creases 11 that simulate pleats. When the shade is fully extended as shown in FIG. 1 it is rectilinear in shape, having a straight horizontal bottom edge 12 that conforms to the shape of a typical window opening W, but the bottom takes the shape of an inverted fan 13 when the shade is partially or fully raised as shown in FIGS. 2 and 3, respectively.

Figure 5:
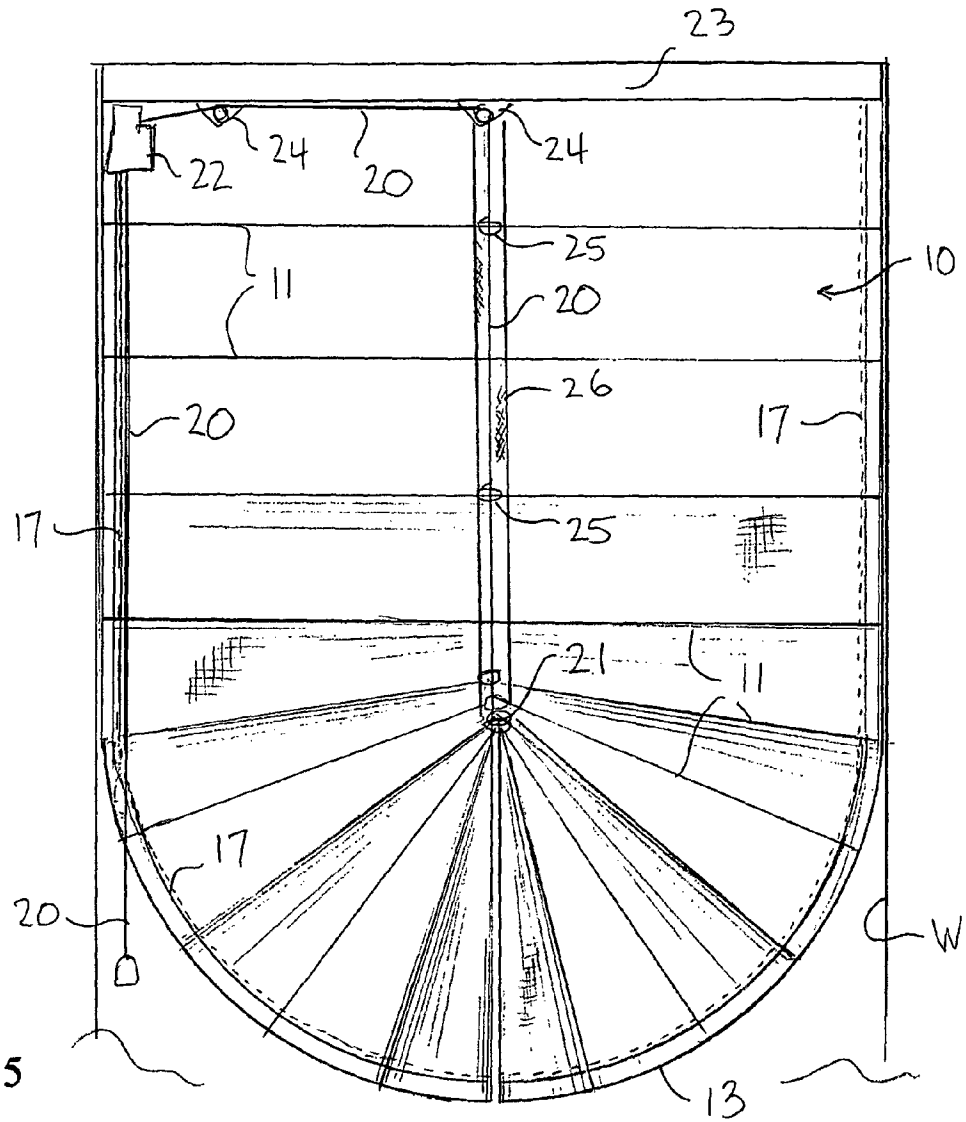
FIG. 5 is a slightly enlarged rear view in elevation of the shade of FIG. 2.
Figure 7:
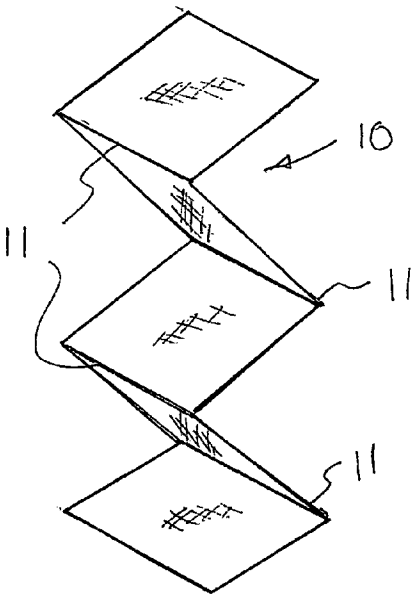
FIG. 7 is a somewhat schematic perspective side view of the shade of the invention showing the pleated folds.
Figure 6:
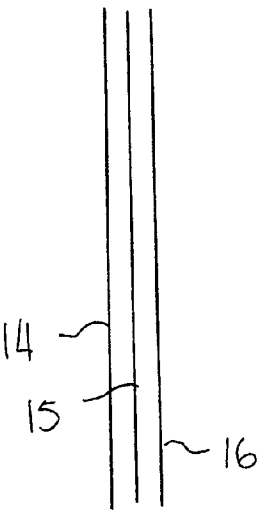
FIG. 6 is a somewhat schematic, fragmentary, exploded side view showing the three layers of material forming the multi-layered construction of the shade of the invention.

As seen best in FIG. 6, the shade of the invention is multi-layered, comprising a front layer 14 selected from a desired fabric, an intermediate layer 15 of a fusible interfacing, and a back layer 16 selected from a desired lining material. The three layers are folded and stitched together at opposite side edges of the shade so that the seam 17 is on the back of the shade as seen best in FIG. 5, whereby the front is uniform and free of seams. The multi-layered material of the shade is accordion folded as shown in FIG. 7, for example, and then ironed to permanently crease the fusible interfacing. The creases can be formed one at a time by folding each panel and then individually ironing or otherwise suitably heating and pressing it, or all the creases can be formed simultaneously by folding all the panels and then ironing them or otherwise suitably heating and pressing them in one step. The creases give the shade the appearance of being pleated when it is in a lowered position, or unfolded, and promote or induce folding of the shade into an accordion-folded pleated shape when the shade is raised, or folded. The interfacing also imparts stiffness to the shade and helps the shade maintain: its shape. In a preferred embodiment the interfacing is a fusible non-woven interfacing comprising 75% polyester and 25% rayon, available from Jo-Ann Stores, Inc.

Figure 4:
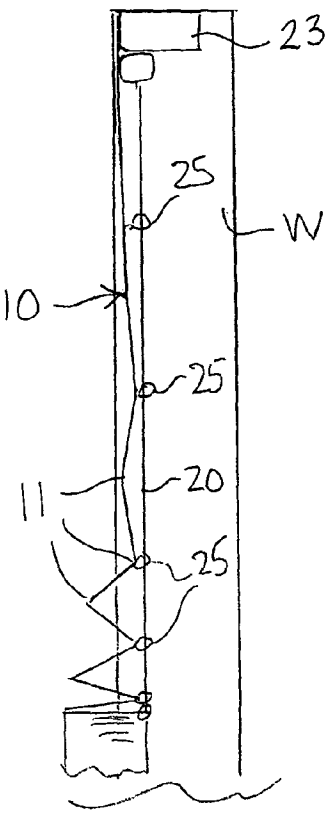
FIG. 4 is a somewhat schematic side view in elevation of the shade of FIG. 2.

As seen best in FIG. 5, a single pull cord 20 extends behind the shade and is connected at its distal end 21 to the middle of the bottom edge of the shade. Thus, when the pull cord is operated it pulls the shade up from the middle of its bottom edge as shown in FIGS. 2-5. The cord extends through a conventional commercially available cord latch and release mechanism 22 mounted near one end of a head rail 23 at the top edge of the shade, and through at least one pulley 24 mounted to the head rail intermediate its ends. Guide rings 25 are attached to the back of the shade along its vertical centerline, and the cord also extends through the guide rings, which are attached only to alternate pleat creases so that the shade can fold into its pleated design when it is raised, as depicted in FIG. 4, for example. A narrow strip of reinforcing material 26 is affixed to the back of the shade along its vertical centerline CL to reinforce attachment of the guide rings to the shade. The reinforcing material can be affixed by stitching or adhesive or other suitable means (not shown).

Figure 9:
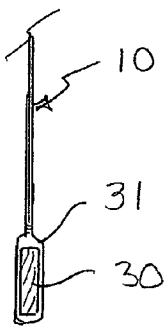
FIG. 9 is an enlarged fragmentary view in section, taken along line 9-9 in FIG. 8.
Figure 8:
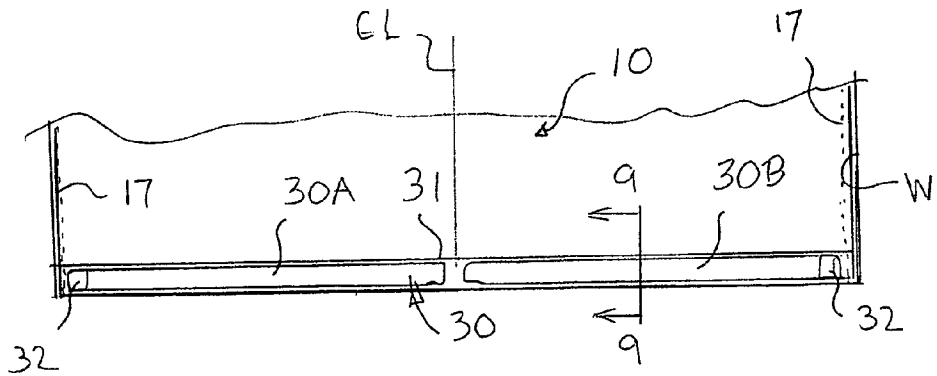
FIG. 8 is a slightly enlarged fragmentary rear view in elevation of a bottom end of the shade of the invention, showing the two-part bottom rail and stitching at the sides of the shade.

As seen best in FIGS. 8 and 9, a bottom rail 30 is held within a pocket 31 sewn into the bottom edge of the shade of the invention to weight the bottom of the shade and to maintain the shape of the bottom edge. The rail comprises two parts, 30A and 30B, each extending from a first end at an outer side edge of the bottom of the shade to a second end at the midportion of the bottom edge, whereby when the pull cord is operated to pull up the shade, the two parts of the bottom rail pivot downwardly about the midpoint of the bottom edge of the shade, imparting an inverted fan shape to the bottom edge. In a preferred embodiment the outer ends of the rail parts 30A and 30B are weighted as at 32 to facilitate downward pivoting of the rail parts and forming of the inverted fan shape when the center of the shade is pulled up by the pull cord. The two-part bottom rail also preferably is made of wood.

The shade of the invention is simple in construction, easy to operate, and has the style of a Roman shade without requiring the excess sewing and material normally employed in a conventional Roman shade. Further, the shade of the invention has a rectilinear shape when fully extended, so that the bottom edge can conform to the rectilinear shape of a typical window opening, but forms an inverted fan shape at its bottom when it is partially or fully raised.

While particular embodiments of the invention have been illustrated and described in detail herein, it should be understood that various changes and modifications may be made in the invention without departing from the spirit and intent of the invention as defined by the appended claims.

What is claimed is:

1. A window covering comprising a pleated Roman shade having a straight bottom edge that forms into an inverted fan shape when the shade is raised, wherein said shade further comprises:

a textile material that can be draped, folded and creased, said material comprising a front layer selected from a desired fabric, an intermediate layer of a fusible interfacing, and a back layer selected from a desired lining material;

a plurality of substantially equally spaced apart parallel permanent creases formed in the material to simulate pleats when the shade is in a lowered position and to induce folding of the material and the formation of accordion-folded pleats when the shade is raised, said creases being formed by folding said material and applying heat, wherein said interfacing is fused to only said back layer to form a laminate of said interfacing and said back layer that imparts stiffness to the shade and maintains its shape;

guide rings at the back of the shade along its vertical centerline, said guide rings attached only to alternate creases;

a single pull cord extending behind the shade and connected with a bottom edge of the shade at a midportion thereof so that the shade is lifted from the bottom edge and along a vertical centerline thereof when the cord is pulled to raise the shade, forming the inverted fan shape at the bottom edge, said pull cord extending through the guide rings; and opposite side edges of the front layer are folded around opposite side edges of the fused together interfacing and back layer and the layers are stitched together at said opposite side edges to form seams on only a back surface of the shade.

2. A window covering as claimed in claim 1, wherein:

the guide rings are pre-attached to a narrow strip of material that is affixed to the back of the shade along its vertical centerline.

3. A window covering as claimed in claim 2, wherein:

a bottom rail is held within a pocket sewn into the bottom edge of the shade to weight the bottom of the shade and to maintain the shape of the bottom edge.

4. A window covering as claimed in claim 3, wherein:

the bottom rail comprises two parts, each extending from a first end at an outer side edge of the bottom of the shade to a second end at the midportion of the bottom edge, whereby when the pull cord is operated to pull up the shade, the two parts of the bottom rail pivot downwardly about the midpoint of the bottom edge of the shade, imparting said inverted fan shape to the bottom edge.

5. A window covering as claimed in claim 4, wherein:

the two-part bottom rail is made of wood and the outer ends are weighted to facilitate downward folding of the bottom rail and forming of the inverted fan shape when the center of the shade is pulled up by the pull cord.

6. A window covering as claimed in claim 1, wherein:

a bottom rail is held within a pocket sewn into the bottom edge of the shade to weight the bottom of the shade and to maintain the shape of the bottom edge, said bottom rail comprising two parts, each extending from a first end at an outer side edge of the bottom of the shade to a second end at the midportion of the bottom edge, whereby when the pull cord is operated to pull up the shade, the two parts of the bottom rail pivot downwardly about the midpoint of the bottom edge of the shade, imparting said inverted fan shape to the bottom edge.

7. A window covering as claimed in claim 6, wherein:

the two-part bottom rail is made of wood and the outer ends are weighted to facilitate downward folding of the bottom rail and forming of the inverted fan shape when the center of the shade is pulled up by the pull cord.

8. A window covering as claimed in claim 1, wherein:

the single pull cord comprises the only pull cord attached to the shade.

9. A window covering as claimed in claim 7, wherein:

the single pull cord comprises the only pull cord attached to the shade.

* * * * *